US006751324B2

(12) United States Patent
Watanabe et al.

(10) Patent No.: US 6,751,324 B2
(45) Date of Patent: Jun. 15, 2004

(54) SPEAKER DEVICE

(75) Inventors: Shigeru Watanabe, Tendo (JP); Tomiaki Ando, Tendo (JP)

(73) Assignees: Pioneer Corporation, Tokyo-to (JP); Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 09/812,569

(22) Filed: Mar. 21, 2001

(65) Prior Publication Data

US 2001/0024506 A1 Sep. 27, 2001

(30) Foreign Application Priority Data

Mar. 21, 2000 (JP) ..... P2000-083215

(51) Int. Cl.[7] ..... H04R 25/00

(52) U.S. Cl. ..... 381/190; 381/424; 381/432; 381/398

(58) Field of Search ..... 381/152, 173, 381/190, 191, 396, 398, 423, 424, 426, 432; 310/311, 322, 325; 367/155, 157, 180

(56) References Cited

U.S. PATENT DOCUMENTS 3,860,838 A * 1/1975 Kumon ..... 310/322
4,401,857 A * 8/1983 Morikawa ..... 381/190
4,414,436 A * 11/1983 Sashida et al. ..... 381/152
4,461,930 A * 7/1984 Melillo et al. ..... 381/190
5,295,194 A * 3/1994 Christensen ..... 381/182
5,321,761 A * 6/1994 Kitanishi ..... 381/190

FOREIGN PATENT DOCUMENTS

| | | |
|---|---|---|
| JP | 56-149900 | 11/1981 |
| JP | 63-279700 | 11/1988 |
| JP | 01-135299 | 5/1989 |
| JP | 2-90899 | 3/1990 |
| JP | 4-105499 | 4/1992 |
| JP | 7-226998 | 8/1995 |
| JP | 8-237787 | 9/1996 |
| JP | 09-224299 | 8/1997 |

* cited by examiner

*Primary Examiner*—Suhan Ni
(74) *Attorney, Agent, or Firm*—Sughrue Mion, PLLC

(57) ABSTRACT

The present invention provides a speaker device in which assembly is easy, and which has high sensitivity and low distortion. The speaker device comprises a frame member, a piezoelectric element to which a sound signal is applied, a diaphragm attached to the piezoelectric element, a coil for boosting the sound signal, and a damper attached to the piezoelectric element in the opposite side face to the diaphragm to elastically support the piezoelectric element. The coil is wound with respect to the frame member, and the damper is attached on the frame member.

9 Claims, 4 Drawing Sheets

SPEAKER DEVICE

BACKGROUND OF THE INVENTION

1. Field of the Invention

The present invention relates to a high frequency speaker device.

2. Description of the Prior Art

Known is a speaker called a tweeter constructed in such a manner that a diaphragm such as of a cone type is attached to a piezoelectric element to be driven. In this type of speaker, an alternating voltage is applied to vibrate the piezoelectric element to drive the diaphragm so that a high frequency sound is reproduced. This type of speaker is described in Brazilian Patent No. 38401504 (Patent Application Number PI8401504), Japanese Patent Application Publication No. S46-2716, Japanese Patent Application Publication No. S47-2754, Japanese Patent Application Publication No. S53-38924, and Japanese Patent Application Laid Open No. H5-56497, and the like.

In these speakers, since components such as a piezoelectric element, a diaphragm, and the like are constructed independently and assembled, manufacturing process is complex. For that reason, relative positioning of each component is difficult, and a satisfactory sensitivity may not be obtained.

SUMMARY OF THE INVENTION

An object of the present invention, which was made in view of the above-mentioned aspects, is to provide a speaker device in which assembly is easy and satisfactory performance can be achieved.

A first aspect of the present invention is characterized in that a speaker device comprises a frame member, a piezoelectric element to which a sound signal is applied, a diaphragm attached to the piezoelectric element, a coil for boosting the sound signal, and a damper attached to the piezoelectric element in the opposite side face to the diaphragm to elastically support the piezoelectric element, wherein the coil is wound with respect to the frame member, and the damper is attached on the frame member.

With the speaker device constructed as described above, the coil is wound with respect to the frame member. The damper, the piezoelectric element, and the diaphragm are attached to the frame member. Thus, since the respective components are integrally constructed with the frame member, the manufacture of the speaker device becomes easy.

A second aspect of the present invention, in the speaker device according to the first aspect, is characterized in that the frame member comprises a cylindrical upper portion, a cylindrical lower portion having a smaller diameter than that of the upper portion, and a coupling portion for coupling the upper portion and the lower portion, and the coil is wound around the outer periphery of the lower portion. Thus, the lower portion of the frame member functions as a coil bobbin. Since the lower portion of the frame member has a smaller diameter than the upper portion's diameter, the coil can be accommodated in the step between the upper portion and the lower portion of the frame member.

A third aspect of the present invention, in the speaker device according to the second aspect, is characterized in that the frame member comprises a bottom plate formed perpendicularly to the inner wall of the lower portion, and the damper is arranged on the bottom plate. Thus, the damper is stably fixed on the frame member. Further, since portions for receiving the respective components are formed in advance in the frame member, the respective components can be surely held in suitable places, and operations of the speaker device become stable. Specifically, since the diaphragm can be securely fixed between the frame member and the horn, characteristics of the speaker device can be stabilized. Thus, a speaker device with high sensitivity and low distortion can be achieved.

A fourth aspect of the present invention, in the speaker device according to the first aspect, is characterized by further comprising a horn arranged on a front face of the diaphragm. Thus, an appropriate directivity can be given to an acoustic signal outputted from the speaker device.

A fifth aspect of the present invention, in the speaker device according to the fourth aspect, is characterized in that an outer peripheral portion of the diaphragm is fixed to the horn. A sixth aspect of the present invention, in the speaker device according to the fifth aspect of the present invention, is characterized in that the outer peripheral portion of the diaphragm is held between an upper end portion of the frame member and the horn. Thus, the diaphragm and the horn are stably fixed mutually to each other.

A seventh aspect of the present invention, in the speaker device according to the first aspect, is characterized by further comprising an case body for accommodating the piezoelectric element, the diaphragm, the damper, the coil and the frame member, wherein the frame member is fixed to the case body. Thus, by accommodating the frame member holding the respective components integrally inside the case body, the speaker device can be easily assembled.

An eighth aspect of the present invention, in the speaker device according to the fourth aspect, is characterized by further comprising an case body for accommodating the piezoelectric element, the diaphragm, the damper, the coil and the frame member, wherein the frame member, the horn, and the case body are mutually fixed to each other. Thus, the respective components integrally attached to the frame member, the horn, and the case body are stably fixed mutually to each other.

A ninth aspect of the present invention, in the speaker device according to the third aspect, is characterized in that the frame member has a recess in a lower face of the bottom plate, and a circuit element is accommodated in the recess. Thus, even the circuit element can be fixed integrally to the frame member. Since the circuit element is stably held, the characteristics of the speaker device can be stabilized.

A tenth aspect of the present invention is characterized in that a speaker device comprises a frame member, a piezoelectric element to which a sound signal is applied, a diaphragm attached to the piezoelectric element, a horn arranged on a front face of the diaphragm, and a damper attached on the frame member and attached to the piezoelectric element in the opposite side face to the diaphragm to elastically support the piezoelectric element, wherein an outer peripheral portion of the diaphragm is held between an upper end portion of the frame member and the horn.

With this speaker device constructed as described above, the damper, the piezoelectric element and the diaphragm are attached on the frame member. The outer peripheral portion of the diaphragm is sandwiched between the upper end portion of the frame member and the horn. Thus, since the respective components are integrally constructed with the frame member, the manufacture of the speaker device becomes easy.

An eleventh aspect of the present invention, in the speaker device according to any one of the fourth, fifth, sixth, eighth and tenth aspects, is characterized in that the horn is composed of two members. Thus, formation of the horn itself as well as attachment of the horn to the speaker device can be made easy.

A twelfth aspect of the present invention, in the speaker device according to the eleventh aspect, is characterized in that the two members of the horn have different colors. Thus, the two members can be easily discriminated at the time of assembling the horn, and positioning or the like in assembly becomes easy. Since the horn is formed with the combination of different colors, visual effect as a speaker device is enhanced.

DETAILED DESCRIPTION OF THE PREFERRED EMBODIMENT

Figure 1A:
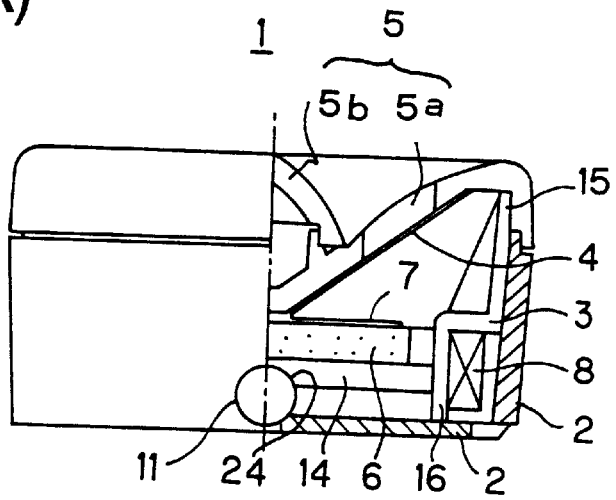
FIGS. 1(A) and 1(B) are views showing the structure of a speaker device according to an embodiment of the present invention.

A preferred embodiment of the present invention will be explained below referring to the drawings.

Figure 1B:
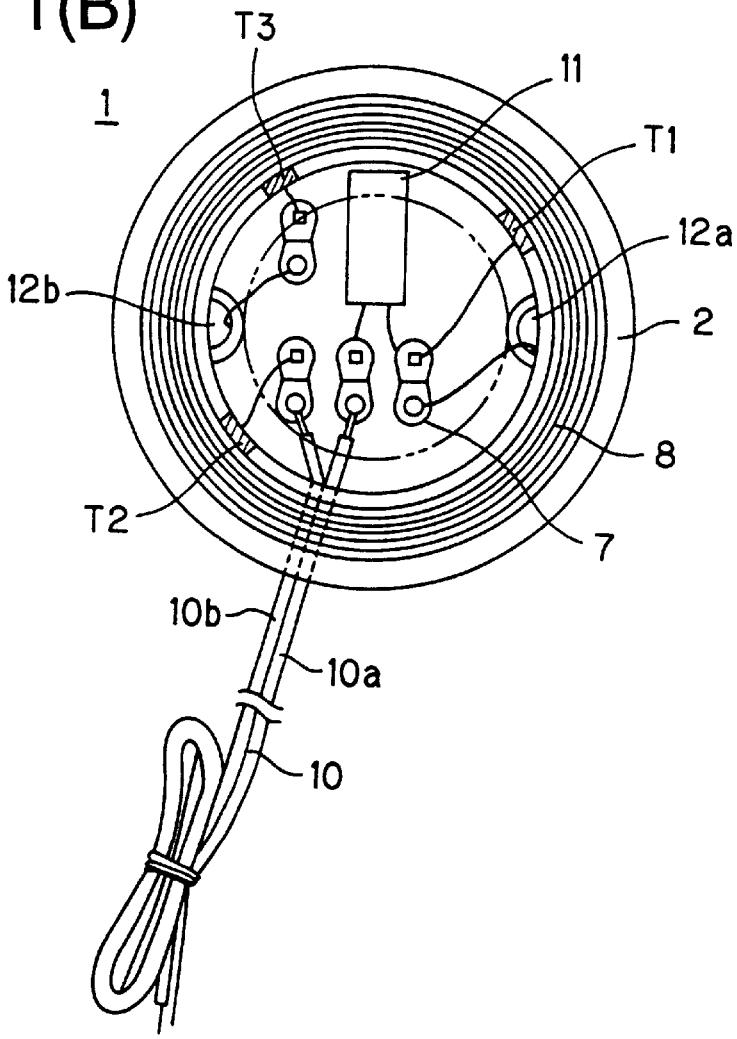

FIGS. 1(A) and 1(B) show the structure of a speaker device according to one embodiment of the present invention. FIG. 1(A) is a partially sectional side view of the speaker device 1, and FIG. 1(B) is a bottom view of the speaker device 1. The speaker device 1 is structured in such a manner that a frame member 3 is arranged in a case body 2. The speaker device 1 of the present invention has a specific feature that various components are integrally coupled to be constructed with respect to the frame member 3.

Figure 2A:
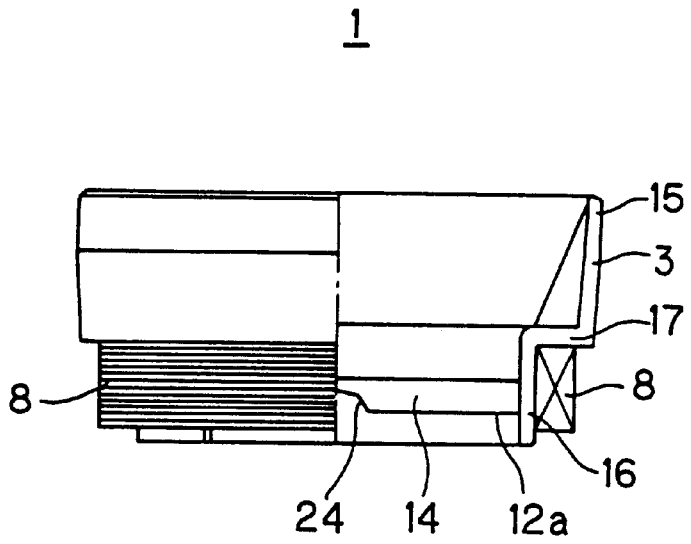
FIGS. 2(A) and 2(B) are views showing the structure of a frame member of the speaker device shown in FIG. 1.
Figure 2B:
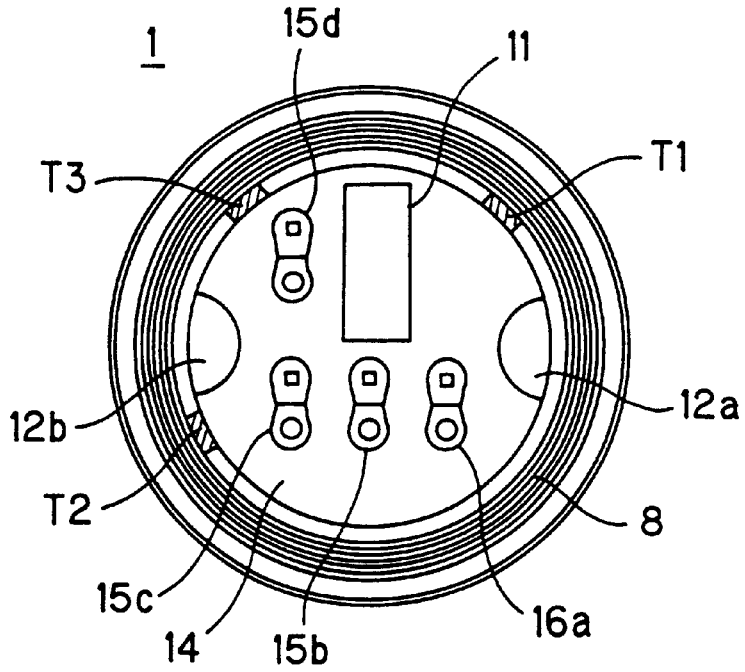

The structure of the frame member 3 is shown in FIGS. 2(A) and 2(B). FIG. 2(A) is a partially sectional side view of the frame member 3, and FIG. 2(B) is a bottom view thereof. As shown in FIGS. 1(A) and 2(A), the frame member 3 is provided with a step, and the diameter of a lower portion 16 is smaller than that of an upper portion 15. The upper portion 15 and the lower portion 16 are coupled by a coupling portion 17. The lower portion 16 has a role of a coil bobbin, and a boost coil (set up coil) 8 is wound therearound. The boost coil 8 has a role of boosting a signal voltage applied to a piezoelectric element described later.

Referring to FIG. 1(A), a bottom plate 14 is formed perpendicularly to the inner wall of the lower portion 16 close to a lower opening of the frame member 3. A damper 6 is attached on the bottom plate 14, and a piezoelectric element 7 is attached on the damper 6. The piezoelectric element 7 vibrates by an electronic signal according to a principle similar to a conventional piezoelectric speaker. The damper 6 is constructed by an elastic material such as urethane, and the vibration that the piezoelectric element 7 generates is absorbed between the bottom plate 14 of the frame member 3 and the piezoelectric element 7 so as to prevent the secondary and tertiary harmonic distortion and the like from being transmitted to the frame member 3.

A diaphragm 4 is arranged on an upper part of the frame member 3. The diaphragm 4 has an inverted cone shape, its tapered bottom portion is attached to the piezoelectric element 7, and a skirt-like upper peripheral portion is adhered and fixed on the upper portion 15 of the frame member 3. A horn 5 for controlling directivity of an acoustic signal outputted from the diaphragm 4 is provided. The horn 5 is composed of two members, that is, the first member 5*a* corresponding to a base and the second member 5*b* corresponding to a central cover. The space between the diaphragm 4 and the horn 5 is preferably about 0.3 mm.

Since it is relatively difficult to integrally mold the entire horn 5, it is composed of the two members as described above. At the time of assembly, the first member 5*a* is first fixed and the second member 5*b* is fixed thereto. The first member 5*a* and the second member 5*b* have different colors from each other. Thus, at the time of assembly, relative positioning of both becomes easy, and assembly becomes easy. The portion of the horn 5 is a visible portion, which forms the external appearance of the speaker device after completion of assembling, and by putting appropriate colors to both the members, it is possible to enhance design and visual effects of the speaker device.

Figure 3A:
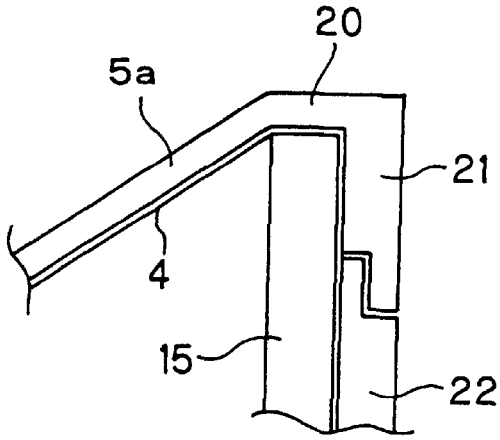
FIGS. 3(A) and 3(B) are an enlarged view of a fixed portion of a diaphragm and a diagram showing the circuit structure of the speaker device of FIG. 1, respectively.

FIG. 3(A) is an enlarged view showing a fixed state of an outer peripheral portion of the diaphragm 4. The outer peripheral portion of the diaphragm 4 is fixed by adhesion on the upper end portion 15 of the frame member 3. Further, the horn 5 is covered thereover. An outer peripheral end portion 21 of the first member 5*a* of the horn 5 bends downward in the outer side of the upper end portion 15 of the frame member 3 to engage with an upper end portion 22 of the case body 2. Thus, an upper peripheral portion 20 of the first member 5*a* of the horn 5 presses the diaphragm 4 from the above, and the outer peripheral portion of the diaphragm 4 is tightly sandwiched and is held between the upper end portion 15 of the frame member 3 and the upper end portion 20 of the first member 5*a* of the horn 5.

A recess 24 for receiving a direct current cut condenser 11 described later is provided in the bottom plate 14 of the frame member.

Figure 3B:
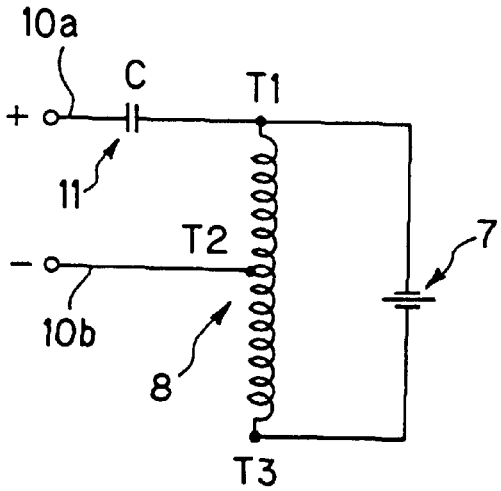

Now, the circuit structure of the speaker device 1 will be explained. FIG. 3(B) shows a circuit diagram of the speaker device 1. In FIG. 3(B), an input signal is supplied to a plus terminal and a minus terminal. The plus terminal is connected to one end contact T1 of the boost coil 8 via the direct current cut condenser 11. The minus terminal is connected to a middle contact T2 of the boost coil 8. A piezoelectric element 7 is connected between the end contact T1 and the middle contact T2 of the coil.

The circuit of FIG. 3(B) is structured as shown in FIG. 1(B). The input signal is supplied to the speaker device 1 through a connection cord 10. The connection cord 10 has a plus side cord 10*a* and a minus side cord 10*b*. A circuit substrate is provided in the bottom plate 14 of the frame member 3, and on the bottom face thereof, the direct current cut condenser 11 and four terminals 15*a* to 15*d* are provided (refer to FIG. 2(B)). In the bottom plate 14 of the frame member, holes 12*a* and 12*b* are provided at mutually opposite positions.

The plus side cord 10*a* is connected to the terminal 15*b*, the direct current cut condenser 11 and the terminal 15*a* in this order. One of wiring from the terminal 15*a* is connected to the end contact T1 of the boost coil 8. Another wiring from the terminal 15*a* passes through the hole 12*a* and is connected to the piezoelectric element 7 arranged on the upper face of the bottom plate 14. The minus side cord 10*b* is connected to the middle contact T2 of the boost coil 8 via the terminal 15*c*. The terminal 15*d* is connected to an end contact T3 of the boost coil and passes through the hole 12*b* to be connected to the piezoelectric element 7. With the circuit structure described above, the input signal vibrates the piezoelectric element 7, and its vibration is transmitted to the diaphragm 4 to be outputted as an acoustic signal.

As described above, in the present invention, the frame member 3 has a role of holding various components in appropriate positions. Specifically, first, the lower portion 16 of the frame member 3 functions as a coil bobbin of the boost coil 8, and the boost coil 8 is wound therearound. The wound boost coil 8 is accommodated inside the step between the upper portion 15 and the lower portion 16 of the frame member so as to prevent the boost coil 8 from coming off the upper portion 15. Compared with a case where the boost coil 8 is wound around a bobbin of a separate body, the size of the entire speaker device can be made smaller.

Figure 4A:
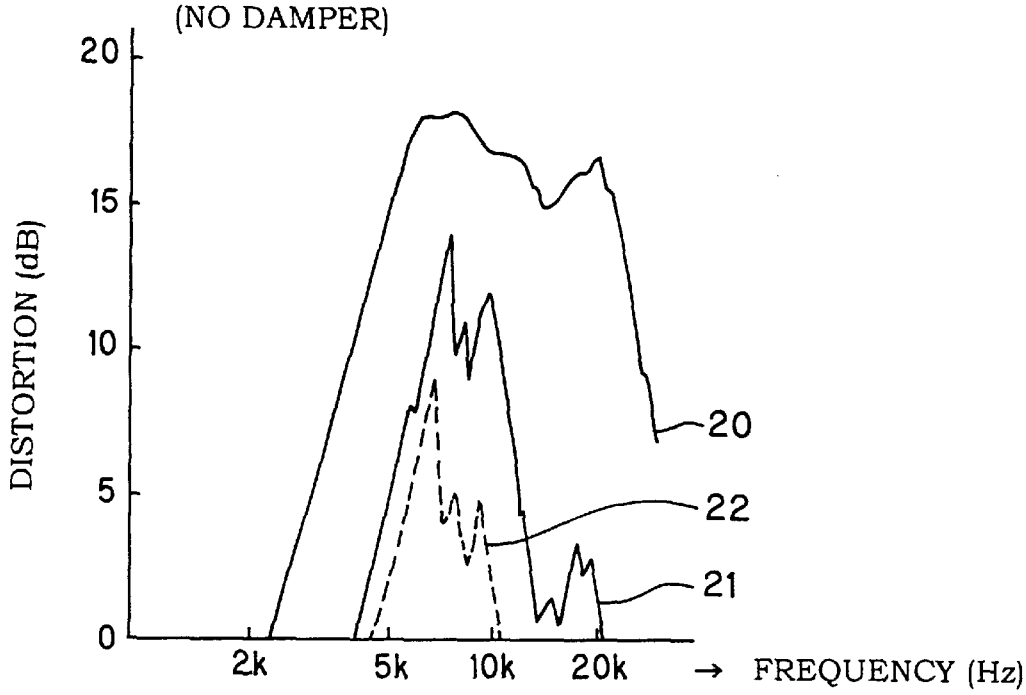
FIGS. 4(A) and 4(B) are views showing frequency characteristics of speaker devices of the present invention.
Figure 4B:
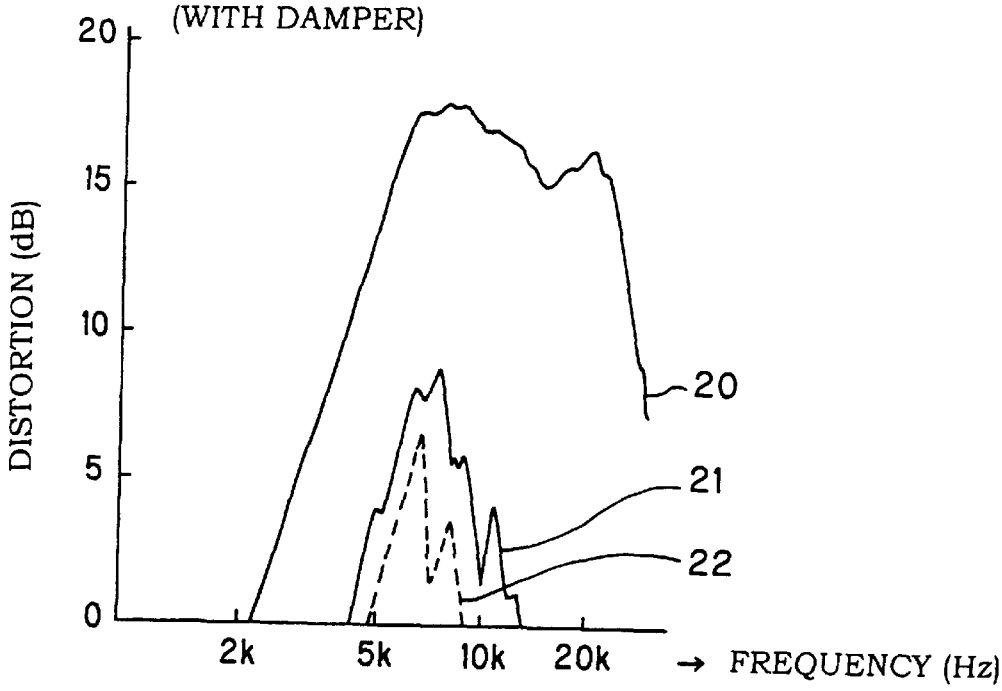

The frame member 3 functions as a support member for the damper 6. By disposing the damper 6 between the frame member 3 and the piezoelectric element 7, the secondary and tertiary harmonic distortions are absorbed by the damper 6, and a frequency characteristic of the speaker device 1 is improved. FIG. 4(A) shows a frequency characteristic of a speaker device of the case where the damper is not provided, and FIG. 4(B) shows a frequency characteristic of the speaker device of the case where the damper is provided. In both drawings, a characteristic 20 shows an acoustic signal outputted from the speaker device, a characteristic 21 shows the secondary harmonic distortion, and a characteristic 22 shows the tertiary harmonic distortion. As it can be understood when FIG. 4(A) and FIG. 4(B) are compared, by providing the damper 6, the secondary and tertiary harmonic distortions can drastically be improved.

The frame member 3 further has a function tightly holding the diaphragm 4 by the upper end portion 15 thereof and the upper peripheral portion 20 of the horn 5 as explained referring to FIG. 3(A). The frame member 3 also has a function of receiving and fixing the direct current cut condenser 11.

Although a coil is employed for boosting the electronic signal in the above present embodiment, a transformer may be employed instead of the boost coil. In that case, the transformer may be placed at a predetermined position inside the case body to be attached to the frame member, and other respective components may be structured and arranged similarly to those of FIG. 1(A).

The entire disclosure of Japanese Patent Application No. 2000-83215 filed on Mar. 21, 2000 including the specification, claims, drawings and summary is incorporated herein by reference in its entirety.

What is claimed is:

1. A speaker device comprising:

a frame member;

a piezoelectric element to which a sound signal is applied;

a diaphragm attached to the piezoelectric element;

a coil for boosting the sound signal;

a damper attached to the piezoelectric element in the opposite side face to the diaphragm to elastically support the piezoelectric element; and a horn arranged on a front face of the diaphragm, the horn being fixed to an upper end of an upper portion of the frame member, wherein the coil is wound with respect to the frame member, and the damper is attached on the frame member, wherein the upper portion of the frame member comprises a cylindrical upper portion, and wherein the frame member comprises said cylindrical upper portion, a cylindrical lower portion having a smaller diameter than that of the upper portion, and a coupling portion for coupling the upper portion and the lower portion, and the coil is wound around the outer periphery of the lower portion.

2. The speaker device according to claim 1, wherein the frame member comprises a bottom plate formed perpendicularly to an inner wall of the lower portion, and the damper is arranged on the bottom plate.

3. The speaker device according to claim 2, wherein the frame member has a recess in a lower face of the bottom plate, and a circuit element is accommodated in the recess.

4. The speaker device according to claim 1, wherein an outer peripheral portion of the diaphragm is fixed to the horn.

5. The speaker device according to claim 4, wherein the outer peripheral portion of the diaphragm is held between an upper end portion of the frame member and the horn.

6. The speaker device according to claim 1, further comprising a case body for accommodating the piezoelectric element, the diaphragm, the damper, the coil, and the frame member, wherein the frame member is fixed to the case body.

7. The speaker device according to claim 1, further comprising a case body for accommodating the piezoelectric element, the diaphragm, the damper, the coil and the frame member, wherein the frame member, the horn, and the case body are mutually fixed to each other.

8. The speaker device according to one of claim 4, 5, or 7, wherein the horn is composed of two members.

9. The speaker device according to claim 1, wherein the two members of the horn have different colors.

* * * * *

UNITED STATES PATENT AND TRADEMARK OFFICE

CERTIFICATE OF CORRECTION

PATENT NO. : 6,751,324 B2
DATED : June 15, 2004
INVENTOR(S) : Watanabe, Shigeru

It is certified that error appears in the above-identified patent and that said Letters Patent is hereby corrected as shown below:

Title page,
Item [*] Notice, should read, -- Subject to any disclaimer, the term of this patent is extended or adjusted under 35 U.S.C. 154 (b) by 116 days. --

Signed and Sealed this

Twenty-eighth Day of June, 2005

JON W. DUDAS
*Director of the United States Patent and Trademark Office*